US007178715B1

(12) United States Patent
Dean

(10) Patent No.: US 7,178,715 B1
(45) Date of Patent: Feb. 20, 2007

(54) MAILBOX WITH PRISM LIGHTING SYSTEM AND MAIL GRABBER

(76) Inventor: George Kevin Dean, 144 Mt. Hebron, Lancaster, KY (US) 40444

( * ) Notice: Subject to any disclaimer, the term of this patent is extended or adjusted under 35 U.S.C. 154(b) by 0 days.

(21) Appl. No.: 11/057,547

(22) Filed: Feb. 14, 2005

Related U.S. Application Data

(60) Provisional application No. 60/544,557, filed on Feb. 16, 2004.

(51) Int. Cl.
*A47G 29/12* (2006.01)

(52) U.S. Cl. ..... 232/38; 232/17; 232/45; 40/566

(58) Field of Classification Search ..... 232/17, 232/38, 45, 29; 99/29–32; 362/155, 154; 40/566, 606.06
See application file for complete search history.

(56) References Cited

U.S. PATENT DOCUMENTS

| | | | | |
|---|---|---|---|---|
| 4,244,512 | A | 1/1981 | Wise | |
| 5,042,716 | A * | 8/1991 | Robbins | 232/39 |
| 6,299,325 | B1 * | 10/2001 | Cathel | 362/183 |
| D471,691 | S | 3/2003 | Ducolon | |
| 6,811,076 | B1 | 11/2004 | Engberg | |
| 6,923,367 | B1 * | 8/2005 | Grossman et al. | 232/17 |
| 6,968,993 | B1 * | 11/2005 | Russell | 232/17 |
| 6,997,373 | B2 * | 2/2006 | Flores | 232/29 |
| 2003/0205614 | A1 * | 11/2003 | Klima et al. | 232/38 |

* cited by examiner

*Primary Examiner*—William L. Miller
(74) *Attorney, Agent, or Firm*—King & Schickli, PLLC

(57) ABSTRACT

A mailbox includes a body having an interior cavity and an opening, a lid connected to the body and covering the opening, a first viewing window in one of the body and the lid and a light dispersion element for dispersing light through the interior cavity of the body so as to allow one to see the contents of the mailbox without opening the lid.

20 Claims, 3 Drawing Sheets

MAILBOX WITH PRISM LIGHTING SYSTEM AND MAIL GRABBER

This application claims the benefit of U.S. Provisional Patent Application Ser. No. 60/544,557 filed on Feb. 16, 2004.

TECHNICAL FIELD

The present invention relates generally to the postal equipment field and, more particularly, to a mailbox and a tool for opening and closing the door on the mailbox and manipulating the mail in the mailbox.

BACKGROUND OF THE INVENTION

It has long been known to provide mailboxes with viewing windows or transparent panels so that both a mailman or the mailbox owner may view the contents of the mailbox before having to open the mailbox door.

This is a feature of both convenience and safety. For example, on a rainy day the mailbox owner may simply drive up to the mailbox in his or her vehicle and peer through the viewing window. In the event the mailbox is empty, the mailbox owner can then simply drive on to an intended destination. Of course, in the absence of the viewing window, the mailbox owner would have had to put down the window of the vehicle and open the mailbox door to confirm the mailbox was empty. Such action would cause the mailbox owner and the interior of the car to become wet with precipitation.

It is also not unusual for vandals to place messy or hazardous materials in a mailbox. The viewing window allows both the mailbox owner and the mailman to confirm the presence or absence of any such materials before opening the door of the mailbox.

Viewing windows for mailboxes are typically relatively small in order to prevent a casual observer from readily viewing the contents of the mailbox. As a result, a large portion of the interior of the mailbox is still typically in deep shadows which prevents complete viewing of the contents of the mailbox through the window. The present invention relates to a mailbox equipped with a device for dispersing light throughout the interior of the mailbox and thereby eliminating the shadows.

SUMMARY OF THE INVENTION

In accordance with the purposes of the present invention as described herein, an improved mailbox is provided. The mailbox comprises a body having an interior cavity and an opening, a lid connected to the body and covering the opening, a first viewing window in one of the body and the lid and a light dispersion element such as a prism for dispersing light through the interior cavity of the body.

In one possible embodiment of the present invention the mailbox also includes a first adjustable stalk. The prism is held on the first adjustable stalk. The first adjustable stalk also includes a mounting sleeve secured to the body of the mailbox. The first adjustable stalk is pivotally held in the mounting sleeve so that the position of the prism may be moved as desired to fully illuminate the interior cavity of the mailbox. In one possible alternative embodiment the mailbox also includes a second adjustable stalk pivotally held in the mounting sleeve. The second adjustable stalk holds a second prism. This prism may be positioned adjacent a second viewing window provided in either the lid or the body.

In either of these embodiments the mailbox may also include a light source. The light source is carried on the first adjustable stalk adjacent the prism. The mailbox may also include a battery compartment and a battery for powering the light source. In the alternative, the mailbox may include a solar panel and storage battery. In addition a switch is provided for activating the light source when desired.

In yet another alternative embodiment the prism is mounted in an aperture in the body, the lid or the first viewing window. Further a light source may be provided on one of the body and the lid. In addition the mailbox may include a battery compartment and battery for powering the light source as well as a switch for activating the light source. A solar panel for charging the battery is optional.

In accordance with yet another aspect of the present invention the mailbox may also include a hand tool including a handle, a shaft and a grabbing element. The grabbing element includes a head having a first face including a first series of ribs and notches. Further the lid may be provided with a handle including a second series of ribs and notches for cooperatively receiving the first series of ribs and notches on the hand tool. This allows one to use the hand tool to open the lid of the mailbox. Of course, the grabbing element is also useful for engaging and pulling mail from the interior cavity of the mailbox. If desired a tie strap, cord, cable or chain may be provided for securing the hand tool to the mailbox.

In the following description there is shown and described several possible embodiments of this invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of this specification, illustrate several aspects of the present invention, and together with the description serve to explain certain principles of the invention. In the drawings.

Reference will now be made in detail to the present preferred embodiment of the invention, an example of which is illustrated in the accompanying drawings.

DETAILED DESCRIPTION OF THE INVENTION

Figure 1:
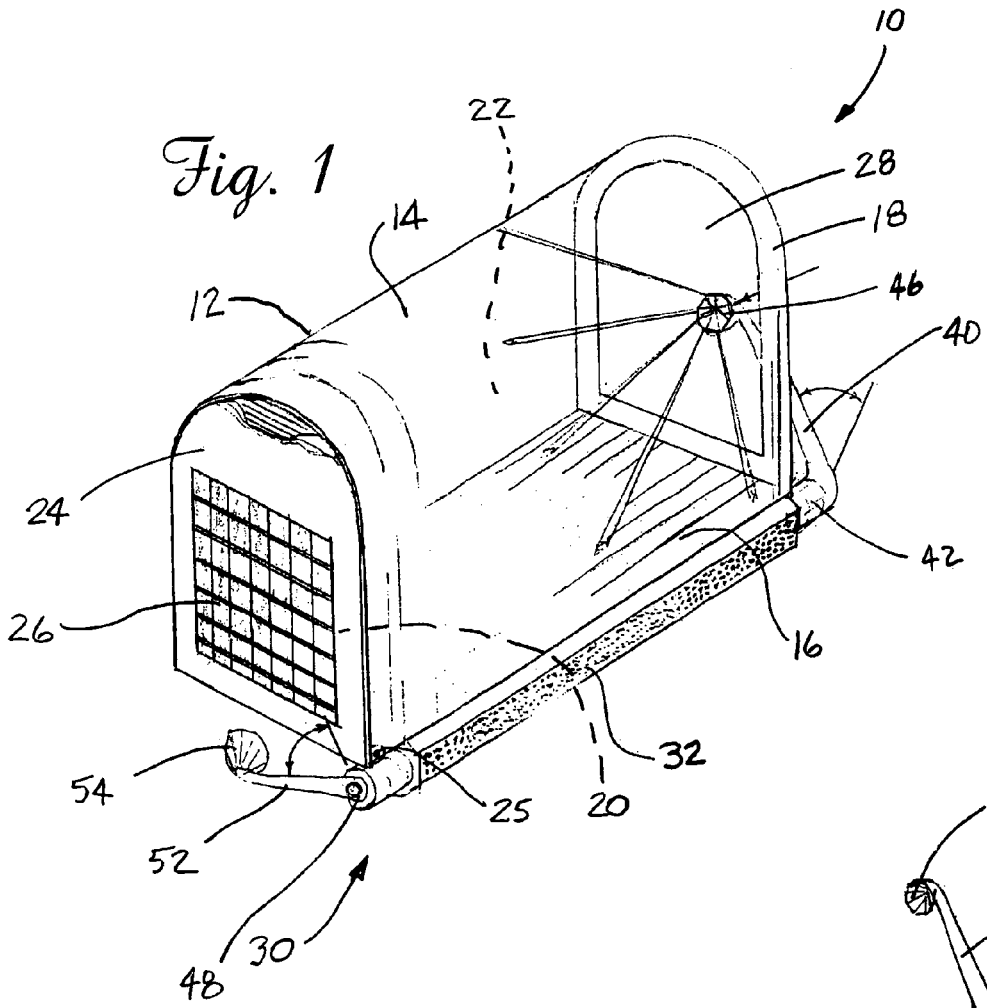
FIG. 1 is a schematical perspective view of a mailbox of the present invention.

Reference is now made to FIG. 1 illustrating the mailbox 10 of the present invention. The mailbox 10 includes a body 12 having a curved wall 14, a bottom wall 16 and a rear wall 18. The body 12 defines an opening 20 and an interior cavity or compartment 22. The opening 20 is closed by a lid 24 that is connected to the body by means of a hinge 25. Thus, the lid 24 may be pivoted relative to the body 12 in order to expose the opening 20 and allow access to the interior cavity or compartment 22.

A first viewing window 26 is provided in the lid 24. While the first viewing window 26 is illustrated as being provided in the lid 24, it should be appreciated that the viewing window could just as easily be provided in the body 12 in, for example, the curved sidewall 14 or the rear wall 18. In the illustrated embodiment a second, optional viewing window 28 is illustrated in the rear wall 18.

A lighting assembly, generally designated by reference numeral 30, is also carried on the body 12 of the mailbox 10. As illustrated, the lighting assembly 30 includes a mounting sleeve 32 having an integral mounting flange 34. Fasteners 36, such as screws, are utilized to secure the mounting sleeve 32 to the body 12 of the mailbox 10. More specifically, the fasteners 36 are inserted through apertures 38 in the flange 34 and threadedly engage cooperating apertures (not shown) in the bottom wall 16.

A first adjustable mounting stalk 40 includes a proximal end 42 received in the mounting sleeve 32 and a distal end 44 that projects from the mounting sleeve and holds a first light dispersion element 46. The light dispersion element 46 may, for example, comprise a multifaceted prism. A second adjustable mounting stalk 48 includes a proximal end 50 received in the mounting sleeve 32 and a projecting distal end 52 holds a second light dispersion element 54 which may also take the form of a prism. As should be appreciated, each of the adjustable mounting stalks 40, 48 may be pivoted in the mounting sleeve 32 and telescoped in and out of the sleeve as necessary in order to position the dispersion elements 46, 54 to disperse and direct natural light through either or both of the viewing windows 26, 28 into the interior cavity or compartment 22 of the mailbox 10. By dispersing the light, the dispersion elements 46, 54 insure that the entire interior cavity or compartment 22 of the mailbox is illuminated so that one can see the contents of the mailbox without opening the lid 24. Advantageously, this is accomplished even if the viewing windows 26, 28 are made relatively small in order to prevent a casual observer from viewing the contents of the mailbox 10.

Figure 2:
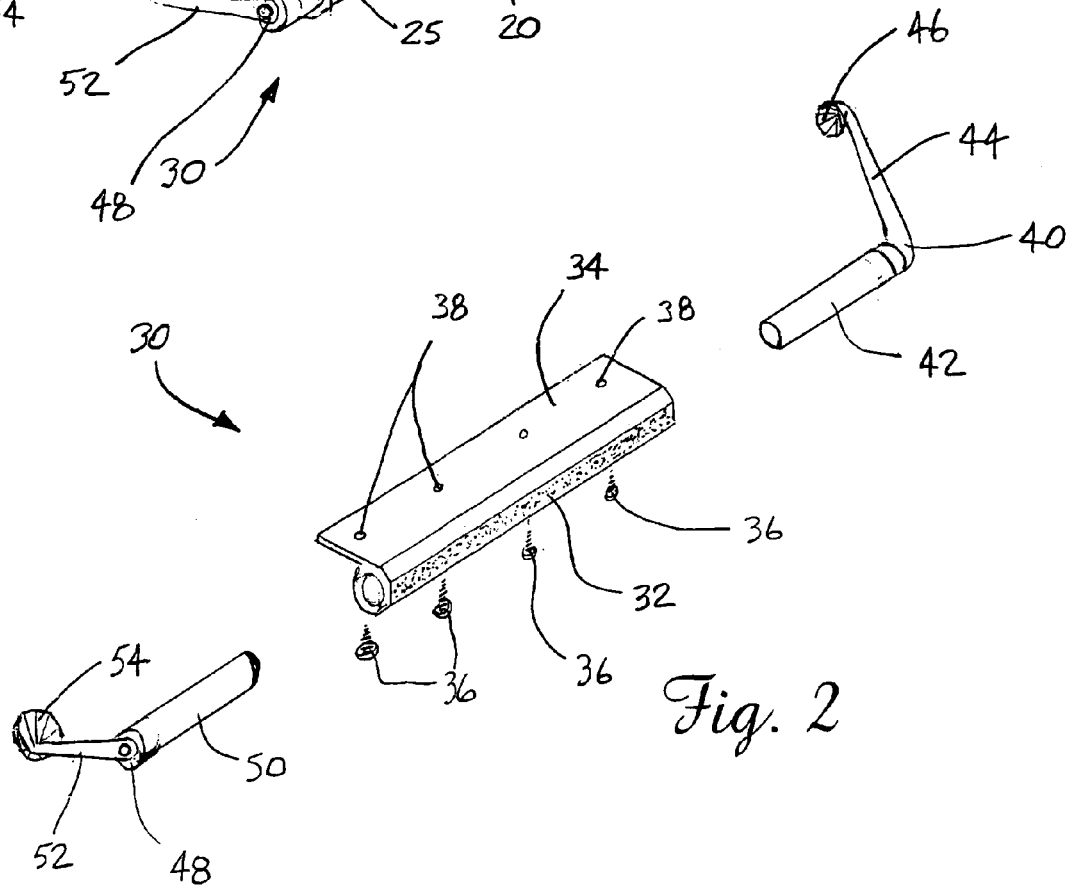
FIG. 2 is an exploded perspective view of the adjustable stalks and mounting sleeve provided on the mailbox illustrated in FIG. 1.
Figure 2A:
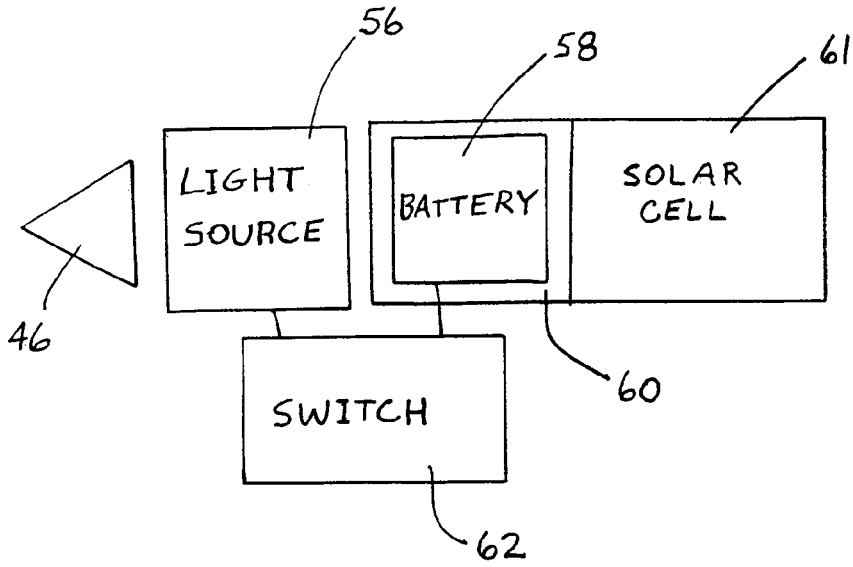
FIG. 2*a* is a schematical representation of the mailbox illustrated in FIGS. 1 and 2 including an optional powered lighting system.

A mailbox 10 with an optional powered lighting system is illustrated in FIG. 2*a*. More specifically, a light source 56 is carried on the first adjustable mounting stalk 40 adjacent the dispersion element 46. The light source 56 may comprise, for example, a low voltage light bulb, LED or the like. It may be powered by a battery 58 held in a battery compartment 60 connected to some portion of the mailbox 10 such as the body 12, the mounting sleeve 32 or the adjustable mounting stalk 40. If desired, a solar cell 61 may be provided to charge the battery 58. A switch 62 provided on the mounting stalk 40 may be depressed to activate the light source 56. The light from the light source 56 is then dispersed through the dispersion element 46 to illuminate the interior cavity or compartment 22 of the mailbox 10 through the viewing window 26 in the absence of daylight.

Figure 3:
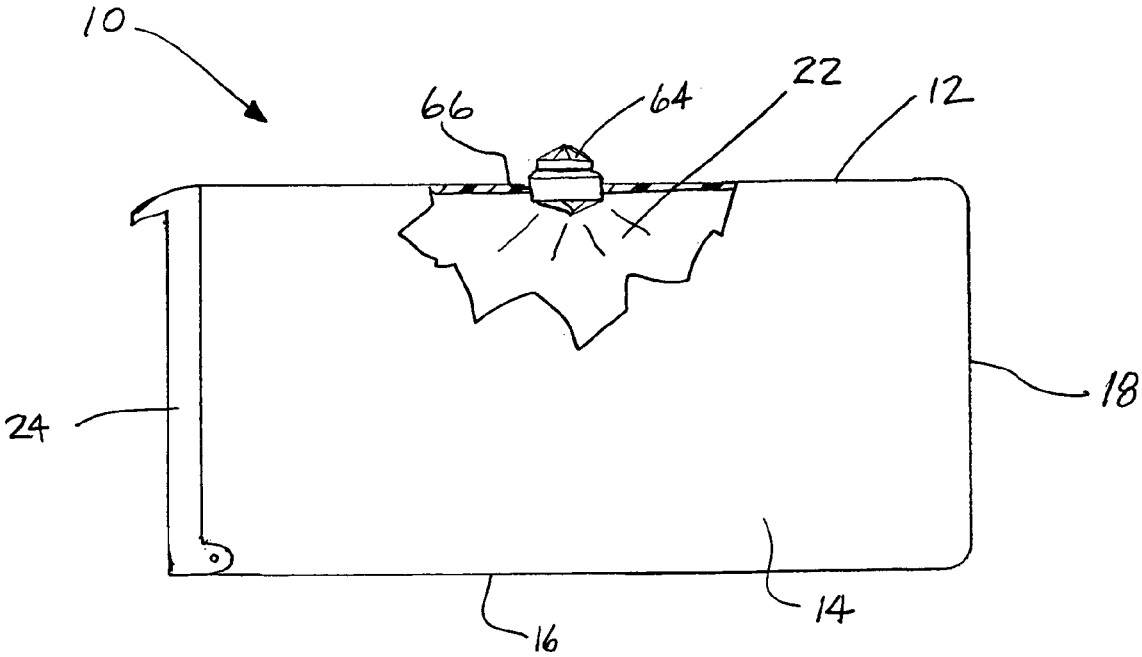
FIG. 3 is a partially cutaway side elevational view of an alternative embodiment of the mailbox of the present invention showing the prism mounted directly in the body of the mailbox.

An alternative embodiment is illustrated in FIG. 3. In this embodiment a light dispersion element 64 is mounted in an aperture 66 in the curved sidewall 14 of the body 12. During daylight hours light enters the element 64 and is dispersed by multiple facets of that element 64 throughout the interior cavity or compartment 22 of the mailbox 10. While not illustrated, it should be appreciated that a light source and associated battery, battery compartment and actuator may also be provided on the body 12 adjacent the light dispersion element 64 to allow illumination during dark hours.

Figure 4:
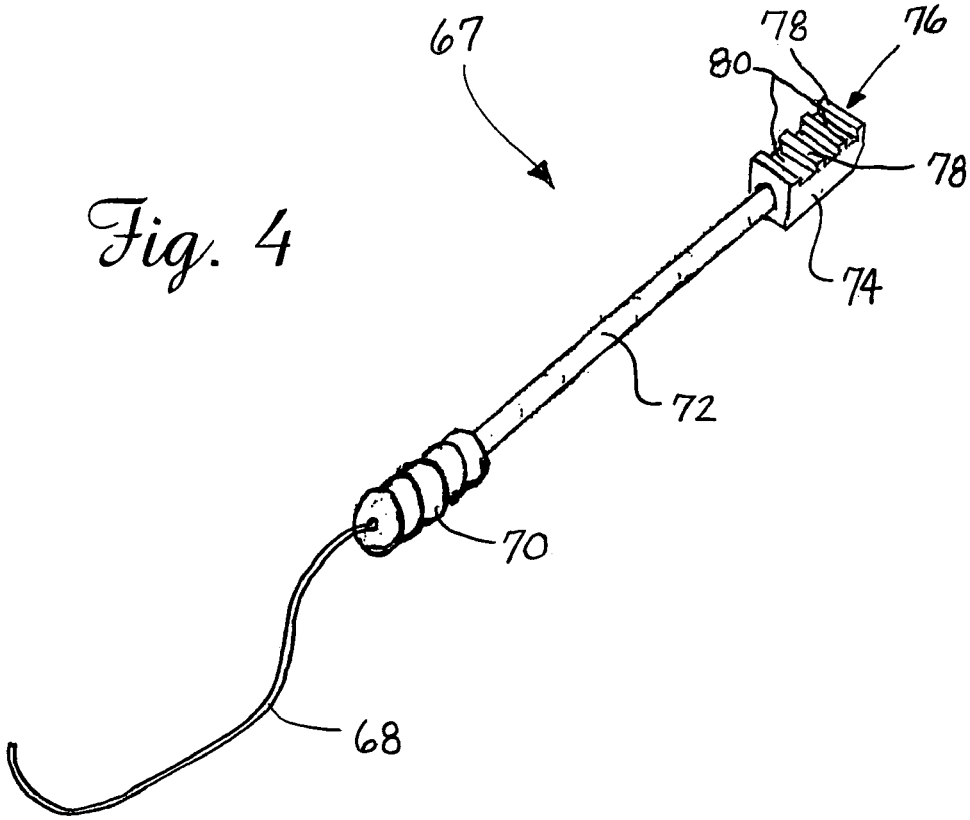
FIG. 4 is a detailed perspective view of a hand tool provided with the mailbox of the present invention and mounted thereto with an optional tie line.

FIG. 4 illustrates a hand tool 67 that may be connected to the mailbox 10 by means of a tie line 68 such as a strap, cord, cable or chain. The hand tool 67 includes a handle 70, a shaft 72 and a grabbing element 74. The grabbing element 74 comprises a head having a face 76 including a first series of alternating ribs 78 and notches 80.

Figure 5:
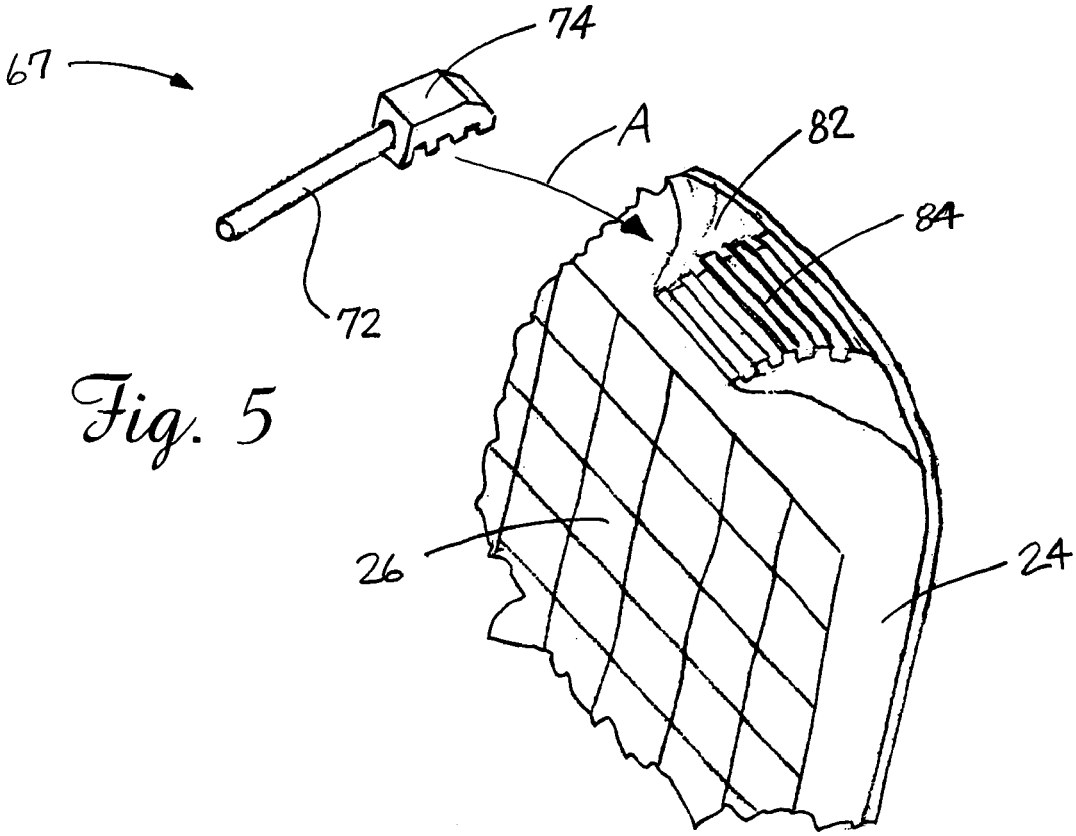
FIG. 5 is a detailed perspective view showing the use of the hand tool to open the lid of the mailbox.

As should be appreciated from viewing FIG. 5, the lid 24 may be provided with a handle 82 including a second series of ribs and notches 84. One may use the hand tool 67 to open the lid 24 by engaging the first series of ribs and notches 78, 80 on the grabbing element 74 with the second series of ribs and notches 84 on the handle 82 (see action arrow A) and manipulating the hand tool to pivot the lid 24 about the hinge 25 and expose the opening 20 leading to the interior cavity or compartment 22 of the mailbox 10. The hand tool 67 may then be used to reach inside and pull any contents or mail from the interior cavity or compartment 22 of the mailbox 10. More specifically, the grabbing element 74 on the end of the hand tool 67 is engaged on the rear edge of the contents and the tool is moved to pull the contents from the compartment. Advantageously, this allows one to reach deep inside the mailbox without significant stretching. This is particularly beneficial when one is recovering the contents of the mailbox from the confines of the driver's seat of an automobile.

The foregoing description of the invention has been presented for purposes of illustration and description. It is not intended to be exhaustive or to limit the invention to the precise form disclosed. Obvious modifications or variations are possible in light of the above teachings. All such modifications and variations are within the scope of the invention as determined by the appended claims when interpreted in accordance with the breadth to which they are fairly, legally and equitably entitled.

What is claimed is:

1. A mailbox, comprising:

a body having an interior cavity and an opening;

a lid connected to the body and covering said opening;

a first viewing window in one of said body and said lid;

a prism for dispersing light through said interior cavity of said body; and a first adjustable stalk, said prism being held on said first adjustable stalk.

2. The mailbox of claim 1, further including a second adjustable stalk and a second prism held on said second adjustable stalk.

3. The mailbox of claim 2, wherein said first and second adjustable stalks include a mounting sleeve secured to said body of said mailbox.

4. The mailbox of claim 3, wherein said first and second adjustable stalks are pivotally received in said mounting sleeve.

5. The mailbox of claim 1, wherein said first adjustable stalk includes a mounting sleeve secured to said body of said mailbox.

6. The mailbox of claim 5, further including a light source carried on said first adjustable stalk adjacent said prism.

7. The mailbox of claim 6, further including a battery compartment and a battery for powering said light source.

8. The mailbox of claim 7, further including a switch for activating said light source.

9. The mailbox of claim 8, further including a solar cell for charging said battery.

10. The mailbox of claim 1, further including a second viewing window in one of said body and said first lid.

11. A mailbox, comprising:

a body having an interior cavity and an opening;

a lid connected to the body and covering said opening;

a first viewing window in one of said body and said lid;

a light dispersion element for dispersing light through said interior cavity of said body;

and a hand tool including a handle, a shaft and a grabbing element for opening said lid.

12. The mailbox of claim 11, further including a light source carried on one of said body and said lid.

13. The mailbox of claim 12, further including a battery compartment and battery for powering said light source.

14. The mailbox of claim 13, further including a switch for activating said light source and a solar cell for charging said battery.

15. The mailbox of claim 11, wherein said grabbing element includes a head having a first face including a first series of ribs and notches.

16. The mailbox of claim 15, wherein said lid includes a handle including a second series of ribs and notches for cooperatively receiving said first series of ribs and notches.

17. The mailbox of claim 16, further including a tie strap for securing said hand tool to said mailbox.

18. A mailbox, comprising:

a body having an interior cavity and an opening;

a lid connected to the body and covering said opening;

a first viewing window in one of said body and said lid;

a prism for dispersing light through said interior cavity of said body;

and a hand tool including a handle, a shaft and a grabbing element for opening said lid.

19. The mailbox of claim 18, wherein said prism is mounted in an aperture in one of said body, said lid and said first viewing window.

20. The mailbox of claim 18, further including a first adjustable stalk, said prism being held on said first adjustable stalk.

* * * * *